US006298632B1

(12) United States Patent
Sherwood

(10) Patent No.: US 6,298,632 B1
(45) Date of Patent: Oct. 9, 2001

(54) METHOD FOR MANUFACTURING A MODULAR BUILDING BLOCK UNIT AND CONSTRUCTION THEREWITH

(76) Inventor: Don T. Sherwood, 4407 Waynesboro, Houston, TX (US) 77035

( * ) Notice: Subject to any disclaimer, the term of this patent is extended or adjusted under 35 U.S.C. 154(b) by 0 days.

(21) Appl. No.: 09/020,748

(22) Filed: Feb. 9, 1998

Related U.S. Application Data

(60) Division of application No. 08/413,275, filed on Mar. 30, 1995, now Pat. No. 5,715,635, which is a continuation-in-part of application No. 08/279,053, filed on Jul. 22, 1994, now abandoned, which is a continuation of application No. 07/848,369, filed on Mar. 9, 1992, now abandoned, which is a continuation-in-part of application No. 07/448,233, filed on Dec. 11, 1989, now abandoned.

(51) Int. Cl.[7] ..... E04G 21/14; E04G 21/22; B28B 1/14; B28B 1/16; B28B 1/30

(52) U.S. Cl. ..... 52/745.1; 52/747.1; 264/259; 264/275; 264/278; 264/279; 264/271.1; 264/297.9; 264/333; 156/304.1; 156/304.5; 425/117

(58) Field of Search ..... 264/274, 259, 264/275, 278, 279, 271.1, 297.9, 333; 156/304.1, 304.5; 425/117, 129.1; 52/286, 592.6, 612, 745.1, 747.1; D25/113

(56) References Cited

U.S. PATENT DOCUMENTS 699,537 * 5/1902 Lahmann .
2,031,900 * 2/1936 Miller .
2,077,750 * 4/1937 Fish .
2,751,775 * 6/1956 Sergovic ..... 428/78
3,256,657 * 6/1966 Phipps ..... 52/223.7
3,299,599 * 1/1967 Zachar .
4,426,815 * 1/1984 Brown .
5,186,883 * 2/1993 Beall, III ..... 264/275
5,667,220 * 9/1997 Kelley, Jr. ..... 264/219
5,715,635 * 2/1998 Sherwood .

* cited by examiner

*Primary Examiner*—Jan H. Silbaugh
*Assistant Examiner*—Michael I. Poe

(57) ABSTRACT

A modular building unit (1–6, 1A) including a building block (10, 10A) having lower and upper faces (9, 9A, 11, 11A), side faces (12, 12A, 13, 13A) and end faces (14, 14A). At least the lower and upper faces are provided with mounting strips (21–24, 53A, 54A) interfit with mating mounting strips (21–24, 53A, 54A) on similar adjacent modular building units (1–6, 1A) to join the adjoining building block units (1–6, 1A) in predetermined dimensionally accurate relationships. A method of securing the mounting strips (21–24, 53A, 54A) to the building block or brick (10, 10A) and the method of interlocking and securing adjacent modular building units (1–6, 1A) to each other are disclosed. A preferred embodiment of mounting strips (53A, 54A) is shown in FIGS. 8–10. A mold (203) is shown in FIG. 12 for the preferred method of forming a building block or brick (200).

50 Claims, 5 Drawing Sheets

FIG.8
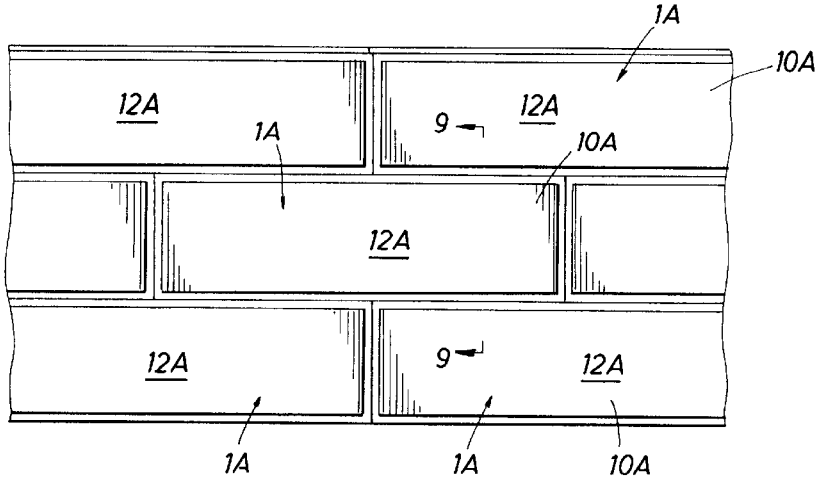
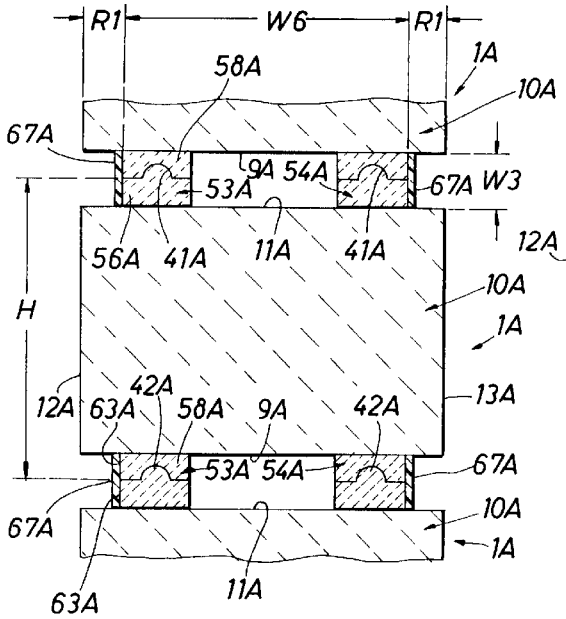
FIG.11
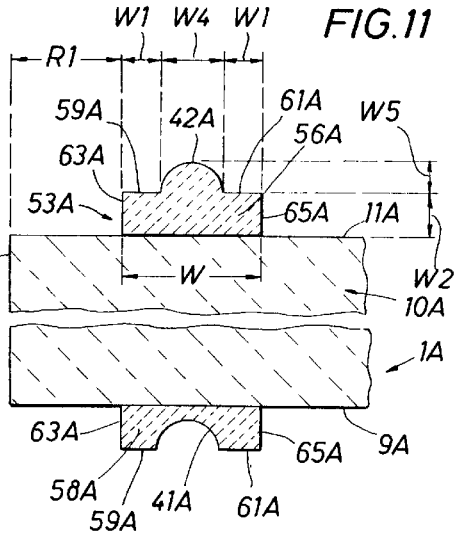
FIG.9
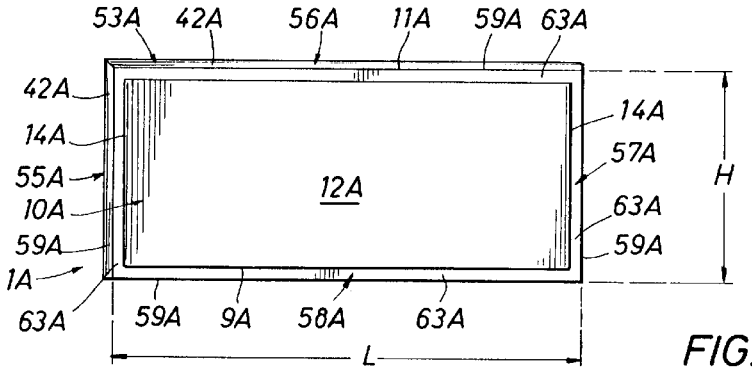
FIG.10

METHOD FOR MANUFACTURING A MODULAR BUILDING BLOCK UNIT AND CONSTRUCTION THEREWITH

REFERENCE TO RELATED APPLICATION

This application is a divisional of application Ser. No. 08/413,275, filed on Mar. 30,1995, now U.S. Pat. No. 5,715,635, issued on Feb. 10, 1998which is a continuation-in-part of application Ser. No. 08/279,053, filed Jul. 22, 1994, abandoned; which is a continuation of application Ser. No. 07/848,369, filed Mar. 9, 1992, abandoned; which is a continuation-in-part of application Ser. No. 07/448,233, filed Dec. 11, 1989, abandoned.

BACKGROUND OF THE INVENTION

1. Field of the Invention

The present invention pertains to masonry construction. More specifically, the present invention pertains to building block units, installation of building block units and methods of manufacturing and utilizing such. In particular, the present invention pertains to a unique building block unit or modular building unit in which a standard brick or other type of building block is placed in a mold and a mounting strip applied to faces of the brick or other type building block and allowed to set as an additional manufacturing step to form the building block unit.

2. Description of the Prior Art

Masonry construction, one of the traditional methods of building, has been utilized for many centuries. Masonry, simply stated, is the assembly of building block units, such as bricks, stone, concrete, etc., by laying such units adjacent to each other in a composite wall, column or other structure. These units are typically joined by some type of mortar which is wet and mixed and applied to the surface of one building unit or block adjacent thereto. The mortar sets up, cementing the building units together as it hardens. Such masonry construction has distinctive architectural characteristics which have been desired throughout the ages, still being the type of construction preferred by many.

Because of its strength, relative uniformity, appearance and other characteristics, the brick, and especially the fired clay brick, has been one of the most used and desired building units for masonry construction. The typical brick is in the shape of a rectangular box and in building a wall with bricks, layers of bricks are laid in stepped or staggered relationships so that an overlying brick straddles the joint of a pair of underlying bricks. While the typical rectangular box-like brick is most common, a number of brick and other building block shapes have been developed over the years to obtain enhanced appearances, more uniform construction, or other characteristics sought for masonry construction. Examples of such specially designed bricks or building blocks may be seen in U.S. Pat. Nos. 3,299,599; 3,479,782; 3,936,987; 4,091,587; and 4,124,961. In fact, there are countless shapes and designs in bricks and other building blocks.

The typical kiln fired bricks utilized in masonry construction are made of clay or shale. The bricks are typically molded, dried and burned in kilns. There are several methods of molding bricks and other building blocks. There are several qualities of bricks and other building blocks, quality being determined by strength, durability, etc. One of the major problems associated with masonry construction is the nonuniformity of building block dimensions due to shrinkage, warping, twisting, etc. Because of these characteristics, mortar is necessary not only to bond the bricks or other building blocks together, but to smooth out the irregularities thereof.

Another major problem associated with masonry construction is the mortar materials utilized to bond the bricks or other building blocks together. In many respects, mortar is the weak link in masonry construction. It normally has less compressive and tensile strength than the building blocks it joins. The shear strength of masonry is a function of the bond strength of mortar to the associated brick or other building block and frictional resistance at the building block-mortar interface. The water tightness of masonry construction is primarily dictated by the characteristics of the mortar which is more water permeable than brick and most other building block materials. While so much depends on the quality of mortar used, mortars are typically mixed at the job site and can easily be incorrectly mixed or used beyond its useful mix life. Thus, even though masonry construction has been utilized for centuries, there are still some inherent problems pertaining to the lack of uniformity of quality and dimensions in the brick or other building blocks and to the weaknesses associated with the mortars used therewith. Accordingly, the search continues for improved masonry construction.

The prior art is generally directed to building units which have blocks in a flush relation to each other and do not include a separate mounting strip extending about the entire periphery of a block for separating adjacent blocks from each other. U.S. Pat. No. 2,077,750 dated Apr. 20, 1937 shows a mounting border along opposed sides of a building block but not about the entire periphery of the building block. U.S. Pat. No. 4,426,815 dated Jan. 24, 1984 likewise does not show a separate mounting strip secured about the periphery of a block and adjacent blocks are in flush relation to each other, not separated by a mounting strip or the like.

SUMMARY OF THE INVENTION

The primary object of the present invention is to provide a unique dimensionally accurate building block unit and method of manufacturing such. The term "building block unit" or "modular building unit" as used herein refers to a brick or other building block in combination with a separate mounting strip preferably formed of mortar which together form a manufactured masonry building block unit for delivery to a building site. While the building block unit of the present invention may utilize brick or other building blocks, the goal is not to redesign the building block per se but to combine the building block with new materials and technology to produce a unique combination. The result of the design and control of building block unit is to make it modular, self-aligning, self-leveling and self-plumbing. The dimensional control of the building block unit is essential for its use in modular construction including a plurality of interfitting building block units. The product is to be a dimensionally accurate building block unit with a separate mounting strip secured to the block in an additional manufacturing step.

The building block unit of the present invention may include a brick or other building block defining a rectangular parallelepiped having parallel rectangular upper and lower faces, parallel rectangular side faces, and parallel rectangular end faces. The upper and lower faces and sometimes one or more of the end faces or a portion of one of the side faces is provided with a mounting strip such as a layer of preapplied and preset mortar. Throughout this description, the terms "preapplied" and "preset" may be used. As used herein, the term "preapplied" simply means the mounting strip or mortar is applied as a manufacturing step. The term "preset" means that the mounting strip is applied and allowed to set prior to use in the field. The preset mounting strip of the building block unit interfits with all mounting strips of mating building block units to connect the building block units together in a predetermined dimensionally accurate relationship. Mounting strips on adjacent mating building block units are secured to each other by a suitable adhesive.

As indicated, the mortar forming the mounting strips of the building block unit of the present invention is preapplied to the building block by a molding process and preset prior to shipment to the field or place of installation. The mounting strip of one building block unit interfits with the mounting strip of an adjacent building block unit. Recessed slots and protruding keys or projections may be provided on adjacent layers of the present building strips for interfitting with corresponding correlative keys and slots, respectively, of adjacent building block units to assure proper orientation thereof. Methods of manufacturing the building block units will be more fully described hereafter.

The preapplication and presetting of mortar on each building block (prior to installation) assures a dimensionally accurate composite building block and when interfitted to adjacent building block units results in a predetermined dimensionally accurate construction. Not only is the final construction dimensionally accurate, it is much stronger and has characteristics which are improved over the prior art, particularly in the mortar area. Due to the fact that the mortar is preapplied and preset under conditions much more favorable than in field mixing operations, the mortar is stronger, less permeable to water, more uniform in appearance, and not susceptible to creep. The mortar joint formed with the present invention is stable and strong and substantially eliminates water infiltration. It also eliminates the need for "striking" or "working" the mortar in the usual masonry sense.

The building block unit of the present invention is self-aligning, self-leveling and self-plumbing. It lends itself to semi-skilled labor or automatic machine installation and eliminates the delay required to curing of wet mortar as in the prior art. The masonry building unit includes a block, such as a brick, and a separate mounting strip secured about the periphery of the block. The block is a rectangular parallelepiped including a pair of parallel rectangular end faces, a pair of parallel rectangular side faces, and parallel rectangular upper and lower faces. At least one mounting strip extends continuously about the periphery of the block including the pair of end faces, and the upper and lower faces. One half of the length of the mounting strip has a projection or key thereon and the remaining half of the length of the mounting strip has a groove. The grooves and projections on opposed mounting strips on adjacent blocks interfit for mounting of adjacent building units in precise horizontal layers with each horizontal layer including a plurality of building units in end to end relation. Each mounting strip has a planar surface extending in a direction parallel to the adjacent faces of the block on which the mounting strip is secured. The parallel planar surfaces on opposed mounting strips of adjacent blocks are in face to face contact with each other and superjacent building units are supported on the planar surface of subjacent mounting strips on the upper faces of the subjacent blocks.

The mounting strips are recessed inwardly from the adjacent side faces of the blocks to provide a continuous recess about the periphery of blocks positioned in horizontal layers of a vertical wall. The outer exposed perpendicular planar surfaces on opposed mounting strips of adjacent blocks are secured together with a suitable adhesive means for securing adjacent building units together. Thus, a smooth joint extends about the entire periphery of the block to provide a smooth uniform appearance between adjacent building units.

Masonry building blocks, such as bricks, have nonuniform dimensions resulting from shrinkage, warping, et cetera, and it is necessary in preformed masonry building units including such blocks to have precise predetermined dimensions so that a uniform wall or the like is constructed. The method of this invention includes a mold for securing the mounting strips to the blocks so that precise dimensions are obtained from the predetermined length between the parallel planar surfaces of the mounting strip on the end faces of the block, the predetermined height between parallel planar surfaces on the upper and lower faces of the block, and a predetermined width between outer surfaces of the pair of mounting strips. The term "parallel planar surfaces" for the mounting strip is interpreted herein as the planar surfaces parallel to the associated faces of the block. The term "perpendicular planar surfaces" for the mounting strips in the preferred embodiment of the invention is interpreted as the planar surfaces perpendicular to the associated faces of the block.

Thus, the primary object of the present invention is to provide a dimensionally accurate building block unit with predetermined dimensions established within specified tolerances based on historically successful building blocks, such as brick. The building blocks, in combination with new materials with predictable performance properties and advanced technology, result in a building block unit from which the resulting construction will be stronger, more watertight and more dimensionally accurate than the prior art. Many other objects and advantages of the invention will be apparent from reading the description which follows in conjunction with the accompanying drawings.

BRIEF DESCRIPTION OF THE DRAWINGS

FIG. 8 is a side elevation of a section of a wall constructed in accordance with a preferred embodiment of the present invention and showing a plurality of horizontal layers of brick blocks for the modular building units;

FIG. 9 is an enlarged section taken generally along line 9—9 of FIG. 8 of the preferred embodiment of the invention;

FIG. 10 is a side elevation of a modular building unit shown in the preferred embodiment of FIG. 7 shown removed from the wall of FIG. 8; and FIG. 11 is an enlarged section of the mounting strip of the preferred embodiment secured to the upper and lower faces of a brick.

DETAILED DESCRIPTION OF PREFERRED EMBODIMENTS OF THE INVENTION

Figure 1:
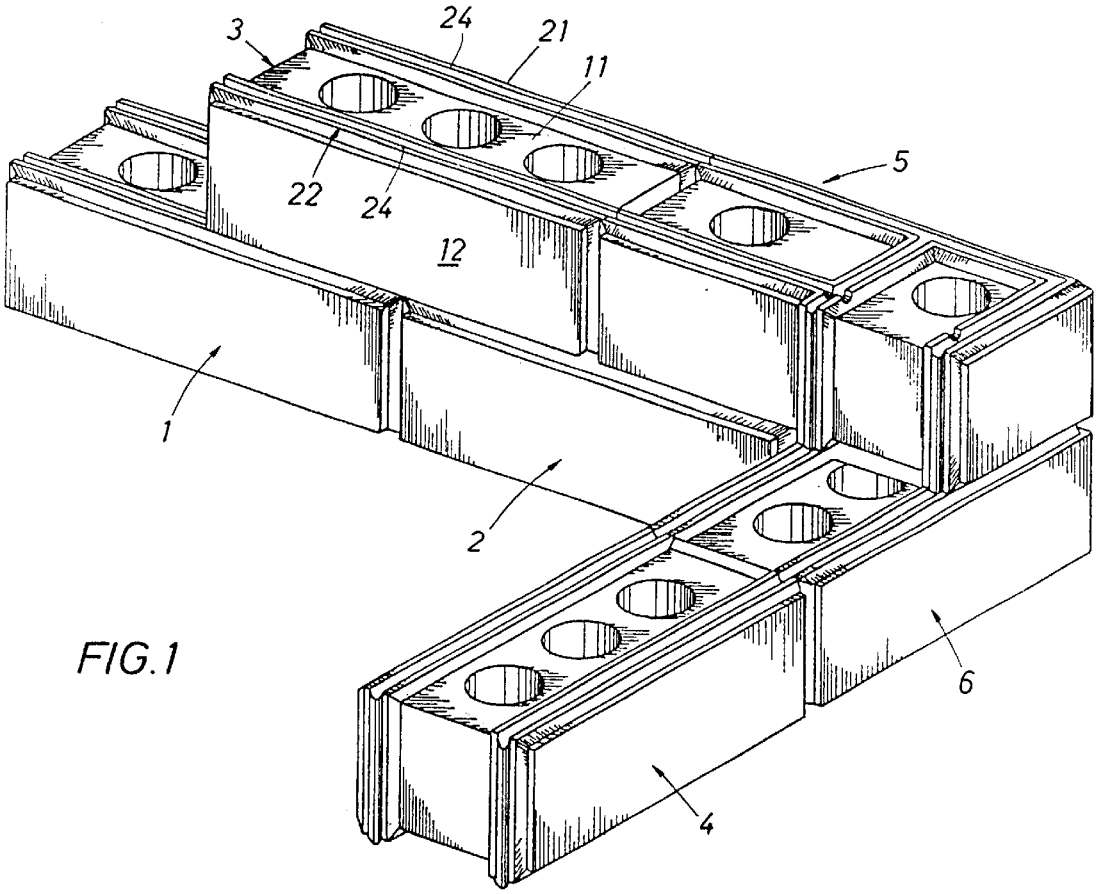
FIG. 1 is an isometric view of a partially constructed corner of a building or a wall utilizing building units, according to a first embodiment of the invention.

Referring first to FIG. 1 for the first embodiment of the invention, there is shown the partially constructed corner of a building or other walled structure made up of several building block units, 1, 2, 3, 4, 5 and 6. As previously mentioned, the term "building unit" or "modular building unit" refers to the building block and the mounting strip which is molded to the building block. Building block units 1, 2, 3 and 4 are referred to as running course building units. Building block units 5 and 6 are referred to as corner building block units. Both types of building block units will be more fully described hereafter.

In the exemplary embodiments, the building blocks are illustrated as bricks. However, the building blocks of the present invention can be brick, stone, concrete, glass, ceramic tile, clay tile (whether used for walls, roofs, floors, etc.) or any other type of building block which is typically joined by mortar, grout or similar materials. Thus, when the term "brick" is used in the following description, it is to be understood that this term is synonymous with the terms "building block" in which the selected building block is brick. Any other selected type of building block can be used and is intended within the scope of the present invention.

Figure 2:
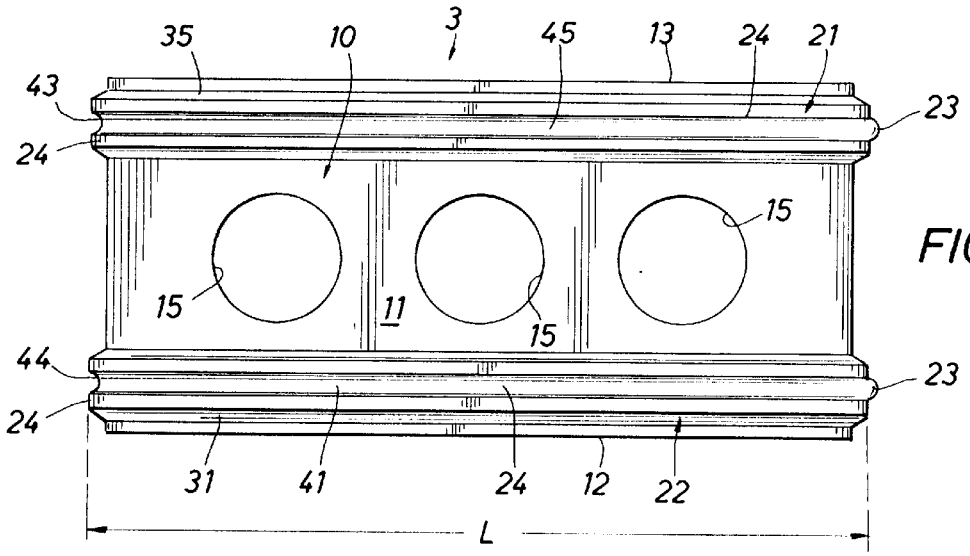
FIGS. 2, 3 and 4 are top view, side view and end views, respectively, of a running course building unit, according to the first embodiment of the invention shown in FIG. 1.
Figure 3:
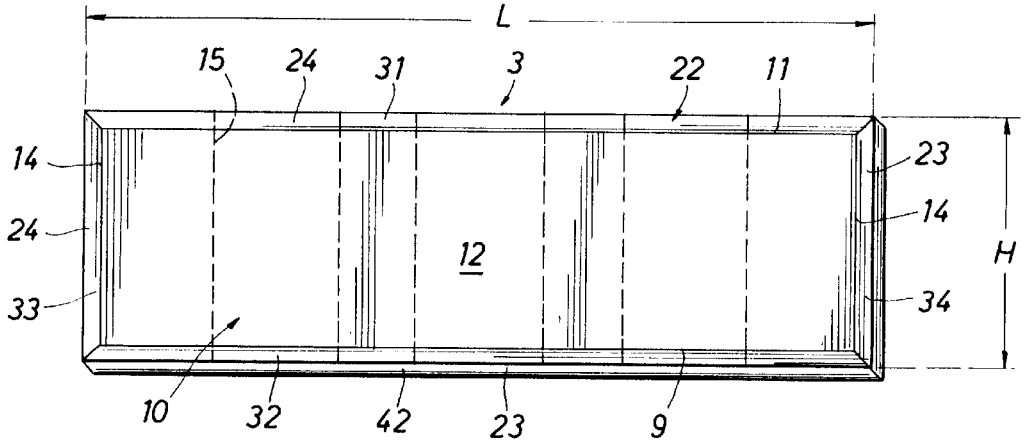
Figure 4:
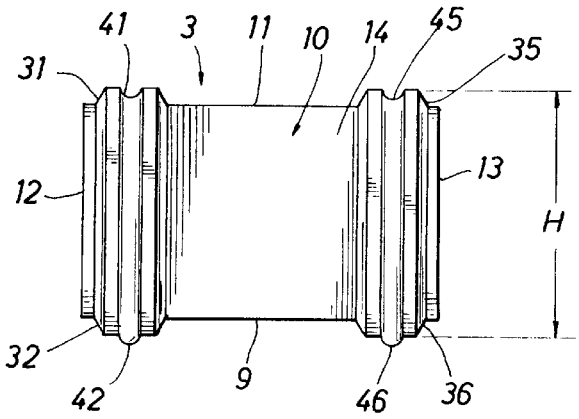

As also seen in FIGS. 2, 3, and 4, the running course block unit 3, (as well as 1, 2 and 4) include, in the exemplary embodiment, a brick 10 having an upper face 11, a lower face 9, first and second parallel side faces 12, 13, and first and second parallel end faces 14. The brick 10 is a typical brick of any type. It may have holes 15 therethrough and may be formed by any process, fired clay brick being preferred.

It is desirable that the lower and upper faces 9, 11 and end faces 14 of the building blocks be provided with a continuous layer or strip of preapplied and preset mortar which extends about substantially the entire periphery of the running course block unit 3. The strip may be a single wide strip having a width extending across the entire width of faces 9, 11, and 14, or may comprise one or more narrow strips having a width extending across only a relatively small portion of the width of faces 9, 11, and 14. As shown in the embodiment of FIGS. 1–4, a pair of parallel narrow strips indicated generally at 21, 22 extend about faces 9, 11 and 14 of running course block unit 3. Upper face 11 and one adjacent end face 14 have slotted or grooved strip portions 24 of strips 21, 22 thereon. Lower face 9 and the other end face 14 have strip portions 23 therein with projecting keys or ribs. Strips of a narrow width would be generally preferred when the mortar is made of expensive materials.

Figure 7:
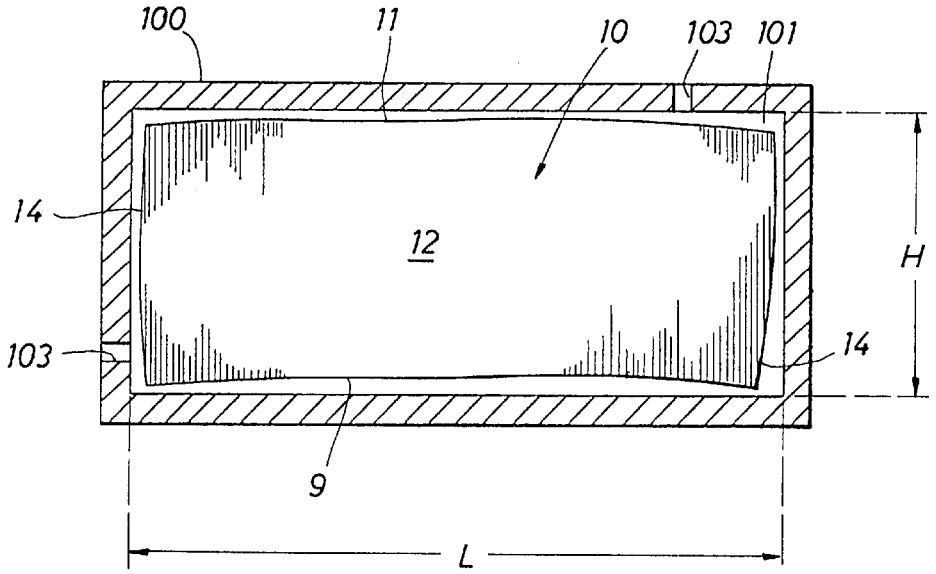
FIG. 7 represents the cross-section of a mold in which a building block is placed in one of the steps of manufacturing a building block unit, according to the first embodiment of the invention.

Whether applied all the way across the brick or in strips as shown in the exemplary embodiments, the mortar would be preapplied to the brick 10 by pouring, as a liquid, into a mold surrounding the brick 10 and allowing it to set in the desired form. The manufacture of a building block unit such as 3 may best be understood with reference to FIG. 7. In FIG. 7, a brick 10, for purposes of illustration shown as being very distorted, is placed in a dimensionally accurate mold 100. The brick 10 may be generally centered in the mold 100 and held in this disposition in any number of known ways, such as a force applied against opposed side faces 12 and 13. It is, of course, noted that voids 101 surround the end faces 14, lower face 9, and upper face 11 of brick 10. No void or space is provided adjacent side faces 12, 13. A flowing mortar mix is dispensed into the voids 101 surrounding end faces 14 and lower and upper faces 9, 11 of the brick 10 through suitable openings 103 in the mold. When a pair of parallel strips 21, 22 are provided on brick 10, a pair of parallel void portions are provided along end faces 14, lower face 9, and upper face 11. After dispensing of the mortar mix within openings 103, openings 103 may be plugged. A portion of the mortar mix is simply to offset the distortions in the brick 10 which are accentuated in FIG. 7 and may vary generally from 1/16 to 1/8 inch for fired clay bricks. The remaining portion of the mortar mix is to provide material for a dimensionally predetermined interface between the building block units formed thereby and adjoining building block units, such as 1, 2, 5 etc. in FIG. 1. The mortar is then allowed to set. The outside surfaces of the resulting brick unit 3 conform to the dimensionally accurate inside surfaces of the mold 100. The mortar may be mixed, poured and set under controlled conditions in a manufacturing facility. After the mortar has cured and hardened, it is described as being "preapplied" and "preset".

The length L and height H of a modular building unit may be accurately obtained as a result of the molding of mounting strips onto bricks 10 between inner surfaces of the mold 100 as shown in FIG. 7 or suitable dies (not shown). The surfaces of the mounting strips contacting opposed surfaces on mounting strips of adjacent brick building units are in conformity with the inner surfaces of mold 100. The length L of the brick unit 3 between the parallel planar surfaces of the mounting strips on lower and upper faces 9, 11 is shown in FIGS. 2 and 7 and the height H of brick unit 3 between parallel planar surfaces of the mounting strips on opposed end faces 14 is shown in FIGS. 3 and 7.

As an example of securing the mounting strips onto a brick, a brick is fed into a mold 100 as shown in FIG. 7. The brick 10 is then positioned by sensors or similar automated equipment within mold 100 and the mold 100 closes around the brick. Suitable mortar flows from a compounding and blending equipment into the mold 100 onto the brick 10. The mortar mounting strip is bonded to the brick 10 under specified controlled conditions, to create a masonry building unit which has a uniform strength and precise external dimensions for interfitting with similar building units. This application, setting and curing of the mortar produces an externally precise mounting strip around the brick 10, of uniform strength. By mixing mortar in a controlled manufacturing environment, exact control may be had over the mixture, and over the variables affecting mortar strength and the formation of brick mortar bonding. Curing of the masonry material in the mounting strip on the brick 10 permits the masonry building unit to cure to full strength before being ejected from the mold. This is accomplished when the mortar is cured to exact uniformity, and the dimensional uniformity of the mortar is set and hardened on the brick 10 while the mortar and brick 10 are held in the mold. Curing the mortar in the mold eliminates the creep and slump that otherwise may occur during unrestrained field cure, and eliminates breaking of the bond between the mortar and brick 10.

Apparatus for mixing and applying a suitable mortar mix includes a blending hopper to which the various materials for the mortar mix are fed for mixing. After mixing in the hopper, the mortar material is dispensed by various conduits to a plurality of separate molds, such as fifty or more molds, in which bricks are positioned. After the mortar mix is dispensed, the conduits and/or blending hopper may then be moved and converted to another batch of molds. The mortar mix is preferably designed for rapid curing in around two (2)

minutes after applied to the brick. Heat may be applied under certain conditions. The materials fed to the blending hopper may, for example, comprise sand, glass particles, cement, a polymer material, water, a fire retardant, and a liquid curing catalyst. A non-shrink portland cement may also be utilized with additives including minerals, filler material, sand, and a suitable catalyst for fast curing.

A satisfactory polymer material is illustrated in U.S. Pat. No. 4,931,490 dated Jun. 5, 1990, the entire disclosure of which is incorporated by this reference. The polymer material may, for example, comprise around (10) percent by weight of the entire mortar mix.

A suitable curing agent or catalyst which also has adhesive properties is sold by Shell Chemical Company, Houston, Tex. under the name "EPI-CURE® 3072 Accelerated Amidoamine Curing Agent". This curing agent forms a bond to concrete or cement and may be utilized in the mortar mix. A suitable bonding agent is sold by Shell Chemical Company, Houston, Tex. under the name "EPI-REZ® WD-510 Waterborne Resin" and may be used with the cement mix. This curing agent is a liquid, bisphenol, A type epoxy resin.

To increase the adhesive properties of the mortar mix, a room temperature, cure adhesive may be added to the mortar mix and may comprise a silica-filled epoxy adhesive of Shell Chemical Company sold under the name "Starting Formulation No. 4000". It may be desirable, particularly when a polymer material is added to the mortar mix to provide a fire retardant material for the mortar mix. A high viscosity methylcellulose material may be added to the mortar mix to provide an adhesive property, such as shown in U.S. Pat. No. 3,169,877 dated Feb. 16, 1965.

Regardless of which mortar materials are selected and even if the building blocks to which they are applied are nonuniform, it can be understood that the mortar, by being preapplied in a dimensionally accurate mold within specified tolerances, will result in extremely accurate outside to outside dimensions so that interfitting building block units will be in a predetermined dimensionally accurate relationship.

It is desirable that the outer surfaces of the mounting strips be recessed inwardly from the adjacent side faces of the block or brick so that a recess is formed about the block to provide a recessed appearance for adjacent building block units. In the exemplary embodiments of FIGS. 1–4, this is accomplished by chamfering the preset mortar edges such as shown at 31, 32, 33, 34, 35, and 36. Of course, other edge configurations could be used. In addition to the upper and lower brick faces having layers of preapplied, preset mortar applied thereto, both end faces of the bricks preferably have a layer of preapplied and preset mortar applied thereto.

It will also be noted, in the first embodiment of the invention shown in FIGS. 1 through 4, that the layer of preset mortar on the upper brick face 11 is provided with several recessed slots 41, 43, 44 and 45. The layer of preset mortar on the lower face would then be provided with a corresponding number of protruding keys or projections 42, 46, etc. These slots 41, 43, 44, 45 and keys 42, 46, etc. are for interfitting engagement with corresponding correlative keys and slots, respectively, of adjacent brick units. The engagement of the keys of one brick unit with the slots of an adjacent brick unit assure the proper orientation thereof during installation. Although the keys and slots of the exemplary embodiment are illustrated as longitudinal keys and slots of semicircular cross-section, it is, of course, to be understood that any number of configurations could be used as long as the keys and slots are mutually and correspondingly engageable. Also, while slots or grooves 41, 45 have been illustrated on upper face 11 of brick 10, and projections 42, 46 have been illustrated on lower face 9 of brick 10 in FIGS. 1–4, it is to be understood that such grooves and projections may be reversed and placed on respective faces 9 and 11, if desired. In many instances it is preferred that projections 42, 46 be positioned on upper face 11 instead of lower face 9.

Figure 5:
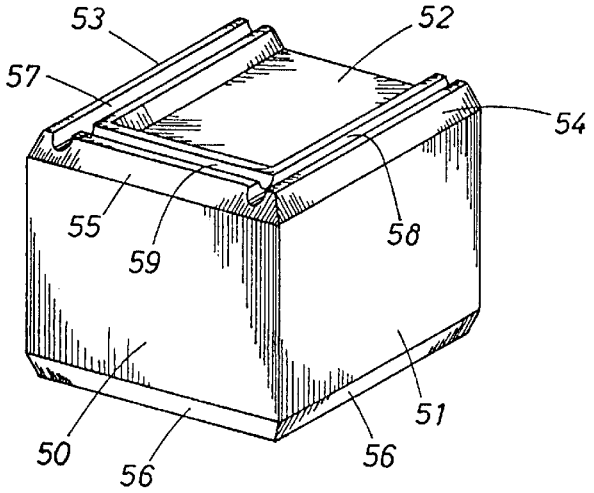
FIG. 5 is an isometric view of a half building block unit, according to the first embodiment of the invention.

FIG. 5 illustrates a half brick unit which is very similar to the full course running brick unit of FIGS. 2, 3 and 4 except that it is half as long and one end face 50 of which is flat, i.e., it has no mortar applied thereto. Thus, end face 50 and contiguous side faces 51, do not have any mortar thereon. Like the full course running brick units, the half brick unit would have layers of preapplied preset mortar on its upper face 52, its lower face (not shown), and the end face (not shown) opposite end face 50. The mortar is in the form of longitudinal mounting strips 53, 54 and transverse mounting strips 55. Strips of mortar on the lower face are partially shown at 56. Slots 57, 58 and 59 and keys on the lower face (not shown) provide orientation. While not apparent from FIG. 5, the end face of the half brick unit opposite end face 50 has mounting strips thereon. Transverse mounting strip 55 may be removed for some applications, if desired. The half brick units are used at windows, doors, etc. between overlapping full brick units with end face 50 positioned adjacent a door frame or window frame, in example.

Figure 6:
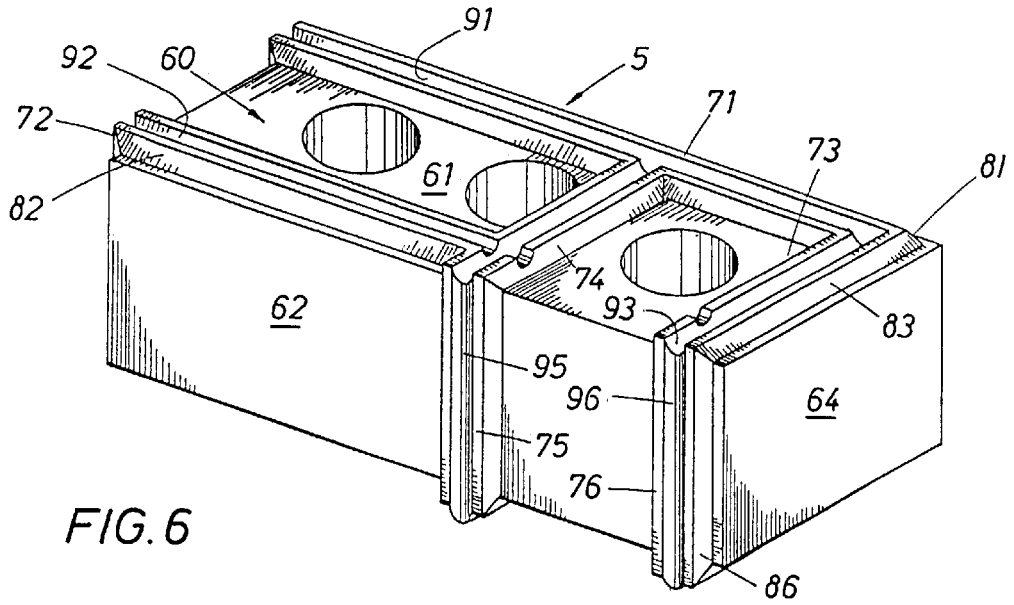
FIG. 6 is an isometric view of a corner building block unit, according to the first embodiment of the invention.

Reference is now made to FIG. 6 where a corner brick unit 5 (also shown in FIG. 1) will be described in more detail. As in the running course brick unit described with reference to FIGS. 2–4, the corner brick unit 5 includes a brick 60 having an upper face 61, a lower face (not shown), first and second side faces 62 (the opposite side face not being shown), and first and second end faces 64 (the opposite end not being shown). Both the upper and lower faces of the brick 60 are provided with a layer of preapplied and preset mortar. In FIG. 6, this layer of preapplied and preset mortar is provided by a plurality of strips or strip positions 71, 72, 73 and 74. As previously mentioned, the mortar may be applied in narrow strips to save on the amount of material used, particularly if the mortar material is expensive. However, if desired, the mortar can be spread all the way across the upper and lower faces of the brick 60.

In addition to the upper and lower faces, a portion of one of the side faces 62, in the exemplary embodiment, is also provided with a layer of preapplied and preset mortar. In the exemplary embodiment, this preset mortar takes the form of strips 75 and 76. The outer edges of the layer of preset mortar on all three faces may be finished as at 81, 82, 83 and 86 so that when placed against layers of preset mortar on other brick units, the preset mortar between adjacent brick units will have a recessed appearance when viewed from the exposed side or end faces. The layer of preapplied and preset mortar provided by the strips 75 and 76 on the side face 62 of the corner brick unit 5 would interfit with a layer of preapplied and preset mortar provided on one end face of an adjacent brick unit which would, for example, overlie the joint between brick units 4 and 6 of FIG. 1. Thus, the side face opposite side face 62, and the end face 64 of the corner brick unit 5 in combination with an adjacent side face of another brick unit would define the outer corner surfaces of the structure formed therefrom.

To assure proper orientation of adjacent brick units, the strips of preapplied and preset mortar 71, 72, 73, 74, 75, 76 are provided with a set of corresponding slots 91, 92, 93, 94 or keys 95, 96, respectively. As previously mentioned, these keys and slots could take other forms as long as they have had correlative mutually engaging forms. The corner brick unit 5 of FIG. 6 is defined as a right corner brick unit. To produce a left corner brick unit, the layer of preapplied and preset mortar (strips 75, 76) would simply be placed on the side face of the brick opposite the side face 62. Such a left corner brick unit is partially shown at 6 in FIG. 1 and extends lengthwise in a direction to the left when facing the corner.

Referring now to the preferred embodiment of the invention shown in FIGS. 8–11, a plurality of similar modular building units 1A are shown in the running course of a wall construction including a plurality of horizontal layers. Each modular building unit 1A includes a brick 10A having a pair of parallel mounting strips generally indicated at 53A and 54A secured about the periphery of brick 10A in a continuous relation. Brick 10A is a rectangular parallelepiped including respective lower and upper parallel rectangular faces 9A and 11A, parallel rectangular side faces 12A and 13A, and parallel rectangular end faces 14A. Each strip 53A, 54A includes strip portion 55A on end face 14A, strip portion 56A on upper face 11A, strip portion 58A on lower face 9A. Strip portions 55A, 56A, 57A, 58A form a continuous strip extending about and supported by faces 9A, 11A, and 14A. Strip portions 55A and 56A are formed with a projection or key 42A and strip portions 57A and 58A are formed with a groove or slot 41A as shown particularly in FIGS. 9 and 11. The body of each strip portion 55A–58A has a pair of planar surfaces 59A and 61A extending in a direction parallel to the adjacent face (9A or 11A as shown in FIGS. 9 and 11) and a pair of planar side surfaces 63A and 65A extending in a direction perpendicular to the adjacent face (9A or 11A as shown in FIGS. 9 and 11). Planar surfaces 59A, 61A are sometimes referred to hereinafter as "parallel" planar surfaces and planar surfaces 63A, 65A are sometimes referred to hereinafter as "perpendicular" planar surfaces, it being understood that "parallel" or "perpendicular" are in reference to the adjacent supporting face of the brick or block 10A to which the strip or strip portion is secured.

Referring to FIG. 9, a plurality of horizontal layers of building units 1A are shown in which interfitting strip portions are illustrated for adjacent horizontal layers. Parallel planar surfaces 59A, 61A on interfitting mounting strips are in face to face contact with each other. Planar surfaces 59A, 61A on lower and upper faces 9A and 11A on each block or brick 10A are spaced as shown at H in FIGS. 8 and 10. In such manner the height H of modular unit 1A is precisely controlled. Also, it is necessary that each modular building unit 1A be constructed of precise dimensions between parallel planar surfaces 59A, 61A on end faces 14A of each block or brick 10A and are spaced as shown at L in FIG. 10. In such manner the length L of each modular unit 1A is precisely controlled. Further, the width W6 extending between outer surfaces 63A on adjacent strips 53A and 54A is of precise dimensions to insure an accurate interfitting relation between superjacent bricks 10A. Planar surfaces 59A and 61A on adjacent or contiguous modular building units 1A are in abutting contact relation with each other as shown particularly in FIG. 9.

Mounting strips 53A, 54A are secured to blocks 10A of modular building units 1A. Grooves 41A on mounting strips 53A and 54A of one modular building unit 1A are adapted to receive projections 42A on adjacent mounting strips 53A and 54A of adjacent modular building units 1A. Modular building units 1A in a single horizontal layer of course are in end to end contact with end faces 14A in opposed relation to each other. Since mounting strips 53A and 54A are rigid, it is necessary that each modular building unit 1A be constructed of precise dimensions as shown in FIG. 7 for the embodiment shown in FIGS. 1–6. Planar surfaces 59A, 61A are formed by the inner surfaces of mold 100 which define height H and length L of modular building unit 1A. Suitable projecting dies or the like (not shown) form the projections and grooves for mounting strips 53A and 54A adjacent planar surfaces 59A and 61A.

For fired clay brick, mounting strips 53A and 54A are bonded to the associated faces of the brick by mold 100 shown in FIG. 7 and the associated apparatus as set forth above for brick 10.

Planar surfaces 59A, 61A each has a width W1 of 3⁄16 inch and planar surfaces 63A, 65A each has a width W2 of 3⁄16 inch as illustrated in FIG. 11. Projections 42A extend outwardly around 1⁄8 inch beyond adjacent planar surfaces 59A, 61A and grooves 41A extend inwardly around 1⁄8 from adjacent planar surfaces 59A, 61A. Strips 53A and 54A are of a total width W of around 9⁄32 inch. Projections 42A are of a width W4 of around 3⁄16 inch and a height W5 of around 3⁄16 inch, for example.

To provide a recess between adjacent modular building units 1A, outer perpendicular surfaces 63A, 65A are recessed inwardly of the adjacent side face 12A or 13A of block 10A a distance R1 of around 1⁄8 inch as shown in FIG. 9. Perpendicular planar outer surfaces 63A on adjacent modular building units 1A are flush with each other about the entire periphery of each modular building unit 1A with a space around 3⁄8 inch in width between adjacent blocks or bricks 10A as shown at W3 in FIG. 9. To secure adjacent building units 1A to each other, a layer of adhesive of a very high bonding strength is sprayed or brushed onto the joint formed by adjoining perpendicular surfaces 63A to hold adjacent surfaces 63A together at the joint. Adhesive layer 67A of a thickness of around 0.015 inch is shown in FIG. 9. An adhesive which has been found to be satisfactory is sold under the name Pliogrip by Ashland Chemical Company, Columbus, Ohio and designated as a Pliogrip 6600 Adhesive System utilizing a two component structural urethane adhesive system.

While two separate mounting strips 53A, 54A have been illustrated, the entire surface of the block faces between strips 53A and 54A may be covered with the material forming strips 53A and 54A, such as mortar, if desired. Also, under certain conditions, a single interlocking mounting strip may be desirable. Projections or keys 42A have been shown on upper face 11A and in this position would act as a more effective barrier to moisture and the like in the event of a break in the seal normally formed by adhesive layer 67A. While corner building block units and half brick units have not been illustrated specifically for the preferred embodiment of FIGS. 8–11, it is understood that corner building block units and half brick units are provided generally similar to those shown in the first embodiment by FIGS. 1, 5, and 6.

As an example of a modular building unit in accordance with the preferred embodiment shown in FIGS. 7–10, block 10A is formed of a clay brick and strips 53A, 54A are formed of mortar. A standard clay brick with somewhat irregular surfaces measures generally as shown below. Strip portions 55A–58A on brick faces 9A, 11A, and 14A have perpendicular surfaces below. Strip portions 55A–58A on brick faces 9A, 11A, and 14A have perpendicular surfaces 63A each of a width W2 of 3⁄16 inch to form a building unit of 4 inches in width (W) and 8 inches in length (L) as indicated below.

| Width (inches) | Height (inches) | Length (inches) | |
|---|---|---|---|
| 3 5/8 | 2 1/4 | 7 5/8 | Manufactured dimensions of irregular brick. |
| 9/16 | 9/16 | | Mounting strips. |
| 4 | 2 5/8 | 8 | Final dimensions of completed brick building unit. |

A corner building unit such as shown on FIG. 6 and a half building unit as shown in FIG. 5 for the embodiment of FIGS. 1–6 may also be utilized in combination with the running building unit shown in FIGS. 8–12 with the slotted strip portions and the projecting strip portions in FIGS. 5 and 6 being reversed.

Figure 12:
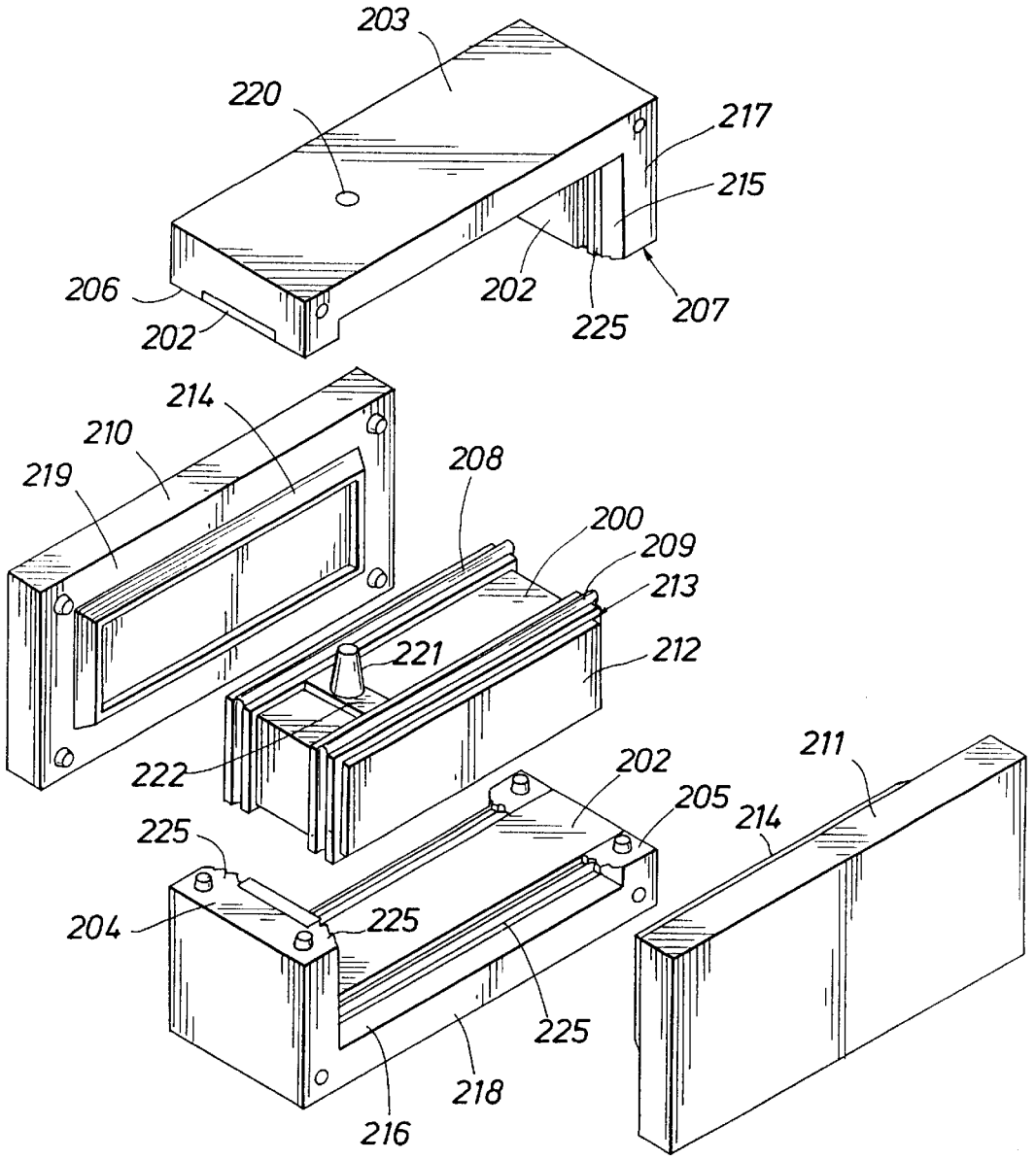
FIG. 12 is an exploded view of a preferred mold for forming the mounting strips on a block.

Referring now to FIG. 12, a suitable mold generally indicated at 203 is shown in an exploded view for forming strips 208, 209 on the building block or brick 200 in accordance with the method of this invention. The mold 203 is particularly designed to maintain the precise dimensions for length L and height H shown in FIG. 10, and for width W6 shown in FIG. 9. The precise dimensions for length L, height H, and width W6 are obtained within a tolerance of about 0.010 inch. A tolerance between about 1/64 inch and 1/32 inch would be satisfactory. While only a single mold 203 is shown for the purpose of illustration, it is understood that a plurality of interconnected molds 203 would be provided. The dimensions L, H, and W6 are comparable to the X, Y and Z axes for brick 200. The moldable material from which strips 208, 209 is formed is preferably of a mortar or polymer material. The mortar or polymer material is applied in an injection process in which strips 208, 209 are molded about the entire periphery of brick 200. Mold 203 duplicates its precision geometry of tongue and groove onto each brick 200.

Variations in the size of brick 200, or the location within mold 203, will not prevent the molded assembly from being a precise building block. Slightly larger blocks will compress the compressible surfaces of the mold while slightly smaller blocks will contain more of the mortar or polymer material on the block surfaces.

Mold 203 includes an upper angle shaped mold section 215, a lower angled shape mold section 216, and side sections 210 and 211. Lower mold section 216 has guide pins and upper mold section 215 has recesses to receive the guide pins in an interfitting relation. Side sections 210, 211 also have guide pins which are received within recesses in end faces 217, 218 (and opposed faces not shown) in side sections 210, 211. Faces 204, 205 on lower section 216 are in abutting contact with faces 206, 207 on upper section 215 when sections 215, 216 are pressed together about brick 200. Lower mold section 216 has a compressible material 202 along its angle shaped inner surface and upper mold section 215 has a similar compressible material. Compressible material 202 is adapted to contact the faces of brick 200 between strips 208 and 209. Suitable void areas or grooves 225 corresponding generally to the shape of strips 208, 209 are formed in upper and lower mold sections 215, 216.

Side mold sections 210, 211 each includes an inwardly extending sealing flange or member 214 of a compressible material adapted to fit about brick 200 and to define the outer faces 213 of strips 208, 209 upon injection of the moldable material for forming strips 208 and 209. Face 219 of side section 210 is adapted to about adjacent faces of upper and lower mold sections 215, 216. An insert including a conical projection 221 and an integral transverse strip 222 has fluid passageways extending therethrough for the flow of injected material into the void areas 225 to form strips 208, 209 of precise dimensions. Conical member 221 is adapted to project from opening 220 of upper mold section 215. Compressible material 202 of upper mold section 215 has a slot therein (not shown) to receive transverse strip 222.

The method of this invention for forming strips 208, 209 comprises the following steps. The brick 200 is first placed within lower mold section 216 supported on compressible material 202. The upper mold section 215 is then installed over the guide pins and pressed closed against lower mold sections 216 until faces 204, 205, 206 and 207 are in abutting relation. Side mold sections 210 and 211 are then installed onto the opposing sides of sections 216, 217 with alignment pins. This arrangement accommodates the precise dimensions for brick 200 defining height H, length L, and width W6 between the outer faces of strips 208, 209. Compressible flanges 214 on side mold sections 210, 211 fit about opposed faces 212 of brick 200 to project over opposed faces 212 a distance of around 3/16 inch to define the adjacent outer surfaces of strips 208, 209. The assembled mold 203 is then clamped closed to achieve abutting contact between surfaces 217, 218 and 219 of side sections 210, 211 and mold sections 215, 206. Then, the moldable material is injected through opening 220 through the passages formed in conical projection 221 and transverse strip 222 for entering the continuous void areas 225 for forming strips 208, 209. The moldable material flows in the void areas 225 about the entire periphery of brick 200. After the moldable material has cured, mold 203 is disassembled and brick 200 is then removed along with the insert defining conical projection 221 and integral transverse strip The method may be automated and performed at a manufacturing site or at a construction site or a remote site.

The method may, if desired, use a non-shrink mortar or an unsaturated polyester polymer. The moldable material is injected into the mold through an opening in conical member 221. The cure time varies with different materials. The total number of molds 203 will vary as the function of the number of brick units required and the material cure time. Thus, a precise uniformity is provided by mold 203 in bricks 200 by precisely maintaining length L, height H, and width W6 within a relatively small tolerance less than 1/32 inch. As a result, a precise wall is formed from a plurality of bricks 200 having strips 208, 209 thereon.

The present invention provides a "building block unit" having "preapplied" and "preset" mortar strips which interfit with preset mortar strips on adjacent building block units to connect the building block units together in predetermined dimensionally accurate relationships. A method of manufacturing the building block unit has been described. Almost all of the deficiencies which make the typical prior art mortar joint the weakest part of masonry construction are eliminated by the preapplied and preset mortar strips of the building block unit of the present invention. The bond or joint between adjacent building block units is watertight, stable and strong. One of the most important features of the building block unit of the present invention is its predetermined accuracy which is the result of molding and setting the mortar prior to installation. This also eliminates creep which is a problem in masonry construction. By mixing and reapplying the mortar, by molding at the place of manufacture, geometrical uniformity and material consistency is obtained through control of: moisture content, material mixture, time, temperature and environment. Due both to the molding application characteristics and material composition of the preapplied and preset mortar, water infiltration characteristics and the compressive, tensile and shear strength of the masonry construction thereof is greatly improved over masonry construction utilizing field applied wet mixed mortar of the prior art.

Geometrical uniformity and material consistency is obtained through the control of moisture content, material mixture, time, temperature, and environment, during the molding of the mounting strips on the brick. The mortared brick is allowed to cure in a mold within a controlled environment. The most critical aspect of the strength of brick masonry is the strength of the mortar to brick bond. This is accomplished when the mortar is cured to exact uniformity and the dimensional uniformity of the mortar is set and hardened on the brick while the mortar and brick are held in the mold. Due to the molding application characteristics and material composition, the compressive, tensile, and shear strength of the unit and the prevention of creep and water infiltration is improved. The mortar and brick bond formed is watertight, stable, strong, and eliminates the need for "striking" or "working" as conventional mortar is used at the site of construction today.

Not only is the strength, integrity and accurateness of masonry construction utilizing the building block unit of the present invention greatly improved, so is its ease of installation. Once a dimensionally accurate base or starting reference is provided, installation is relatively easy. With some preset mortar materials, it is necessary only to place one building block unit on another, and then adhesively secure the building block units to each other. An adhesive is brushed, sprayed or otherwise applied to the adjacent outer perpendicular surfaces of the mounting strips on adjacent building units so that the building block units are bonded together. The degree of skill required for constructing a wall or building with the building units of the present invention is substantially less than conventional masonry construction; yet the final construction is superior in strength, appearance and uniformity. The speed of construction is greatly increased since there is no necessity for waiting for the mortar to dry or set as in conventional methods. In fact, the building block unit of the present invention could be easily used with automated equipment. Also, it is possible that robotics or other advanced automation using corresponding equipment may be utilized for forming a wall from the building block units of this invention.

Several embodiments of the invention have been described herein. The ones illustrated in the drawings utilize brick. It should be clear that the same principles, techniques and procedures can be practiced with stone, concrete, glass, decorative glass block, ceramic tile, clay tile or other types of building blocks. The products and methods of the present invention may be substituted for any conventional masonry construction for attaching building blocks or units of any kind. In fact, the same principles, techniques and procedures could be used in a scaled down building block unit for toys, models and practice purpose. In fact, many variations of the invention will be apparent to those skilled in the art. Thus, it is intended that the scope of the invention be limited only by the claims which follow.

What is claimed is:

1. A method of forming a corner portion of a wall formed of a plurality of interfitting masonry modular building units, comprising the steps of:

locating a corner building block formed of a homogenous material and including a pair of parallel rectangular end faces, a pair of parallel rectangular side faces, and parallel rectangular upper and lower faces;

the corner building block comprising a first molded mounting strip extending along said upper and lower faces and one of said end faces;

locating an adjacent modular building unit extending in one direction and having a molded mounting strip interfitting with said first mounting strip on said one of said end faces on said corner building block;

the corner building block further comprising a second molded mounting strip extending along said upper and lower faces and one of said side faces of said corner block; and locating another adjacent modular building unit extending in a direction at right angles to said first mentioned adjacent modular building unit and interfitting with said second mounting strip on said one of said side faces on said corner building block.

2. The method of claim 1, wherein the steps of locating comprise locating with automated equipment.

3. A method of forming a modular building unit adapted for interfitting with adjacent building units; comprising the steps of:

forming a block formed of a homogenous material and including a pair of parallel rectangular end supporting faces, a pair of parallel rectangular side faces, and parallel rectangular upper and lower supporting faces; and molding a pair of continuous mounting strips extending along and supported on said pair of end supporting faces and said upper and lower supporting faces about the entire periphery of said block and projecting outwardly from said block supporting faces, each of said strips having an outer planar surface extending in a generally perpendicular direction from the adjacent supporting faces of said block and recessed inwardly from the adjacent parallel supporting faces of said block a predetermined amount, said mounting strips secured to said supporting faces and having portions thereon for interfitting with mating portions on adjacent modular building units, said mounting strips being mortar and said block being a clay brick.

4. A method of forming a modular building unit for the corner of a masonry building, comprising the steps of:

forming a block formed of a homogenous material and including a pair of parallel rectangular end faces, a pair of parallel rectangular side faces, and parallel rectangular upper and lower faces;

molding a mounting strip along said upper and lower faces and one of said end faces interfitting with a first adjacent modular building unit extending in one direction; and molding another mounting strip extending along said upper and lower faces and one of said side faces interfitting with a second adjacent modular building unit extending at right angles to said first mentioned modular building unit;

said mounting strips being formed of a material different from said homogenous material of said block and secured to said block after said block is formed.

5. The method of claim 4 wherein the block comprises stone.

6. The method of claim 4 wherein the block comprises concrete.

7. The method of claim 4 wherein the block comprises glass.

8. The method of claim 4 wherein the block comprises tile.

9. The method of claim 4 wherein the block comprises decorative glass block.

10. The method of claim 4 wherein the block comprises a scaled down building block.

11. The method of claim 4 wherein the block comprises brick.

12. The method of claim 4 and further comprising forming the second adjacent modular building unit.

13. The method of claim 12 wherein the second adjacent modular building unit comprises a running course building unit, and wherein the step of forming the second adjacent modular building unit, comprises:

forming a running course block formed of a homogenous material and including a pair of parallel rectangular end supporting faces, a pair of parallel rectangular side faces, and parallel rectangular upper and lower supporting faces; and molding at least one mounting strip extending along and supported on said pair of end supporting faces and said upper and lower supporting faces of said running course block and projecting outwardly from said block supporting faces, said at least one mounting strip having an outer planar surface extending in a generally perpendicular direction from the adjacent supporting faces of said running course block, said at least one mounting strip molded to said supporting faces of said running course block and having portions thereon for interfitting with mating portions on adjacent modular building units.

14. A method of forming a wall of a plurality of interfitting masonry building units; said masonry building units each formed by the steps of:

forming a block including a pair of parallel rectangular end supporting faces, a pair of parallel rectangular side faces, and parallel rectangular upper and lower supporting faces;

molding a separate mounting strip mounted along said pair of end supporting faces and said upper and lower supporting faces about the entire periphery of said block, said mounting strip having portions interfitting with mating portions on adjacent building units connecting said building units to each other;

forming said strip to have an outer planar surface extending in a generally perpendicular direction from the adjacent supporting faces of said block; said outer planar surface extending about the entire periphery of said block and being aligned in a flush relation with a similar outer planar surface on adjoining building units to form a joint therebetween; and the method of forming the wall comprising applying means for securing said flush outer planar surfaces of said joint to each other comprising applying an adhesive means secured to said flush outer planar surfaces.

15. The method of claim 14, wherein the step of applying means for securing comprises applying with automated equipment.

16. The method of claim 14, wherein the method of forming the wall further comprises interfitting masonry building units to precisely orient and space each masonry building unit with respect to at least one adjacent masonry building unit.

17. The method of claim 16, wherein the step of interfitting comprises interfitting with automated equipment.

18. A method of manufacturing a modular building unit having a pair of continuous dimensionally accurate mounting mortar strips about a periphery of a brick having dimensionally inaccurate external dimensions and comprising the following steps:

(a) providing a mold to receive said brick therein with said mold having internal mounting strip molding surfaces including a groove in one portion thereof and a projection in another portion thereof;

b) supporting said brick within said mold with continuous void spaces about said periphery of said brick including end faces of said brick and upper and lower faces of said brick, said internal mounting strip molding surfaces of said mold being dimensionally accurate;

(c) introducing uncured mortar within said mold and filling said void spaces and causing said mortar to define said pair of continuous mounting mortar strips about the periphery of said brick, said internal mounting strip molding surfaces defining dimensionally accurate grooves and projections for interfitting mounting of adjacent modular building units;

(d) causing said mortar on said brick to set within said mold; and (e) removing said brick with said continuous mounting mortar strips thereon from said mold with outer surfaces of said mounting mortar strips being dimensionally accurate.

19. The method of claim 18, wherein said step of supporting said brick within said mold comprises positioning said brick within said mold with automated equipment.

20. The method of claim 18 wherein the brick comprises stone.

21. The method of claim 18 wherein the brick comprises concrete.

22. The method of claim 18 wherein the brick comprises glass.

23. The method of claim 18 wherein the brick comprises tile.

24. The method of claim 18 wherein the brick comprises decorative glass block.

25. The method of claim 18 wherein the brick comprises a scaled down building block.

26. The method of claim 18 wherein the brick comprises a building block.

27. The method of claim 18, including the following steps:

(a) said internal mounting strip molding surfaces forming a projection on said mortar strips from said groove in said mold for one-half a length of each strip; and (b) said internal mounting strip molding surfaces forming a groove on each of said continuous mounting mortar strips from said projection in said mold for a remaining one-half of said length of each strip.

28. The method of claim 27, further comprising:

said internal mounting strip molding surfaces of said mold forming a mating groove for said projection on each of said mounting strips and a mating projection for said groove on each of said mounting strips.

29. The method of claim 27, including the following step:

forming a planar surface on each of said mortar strips on each side of said groove thereon and on each side of said projection thereon parallel to an adjacent associated face of said brick on which each respective strip is mounted.

30. A method of manufacturing a modular building unit having a pair of continuous dimensionally accurate and completely cured mortar mounting strips along at least three faces of a brick having dimensionally inaccurate external dimensions and comprising the following steps:

(a) providing a mold to receive said brick therein, said mold having internal mounting strip molding surfaces for forming grooves and keys for interfitting relation with mounting strip grooves and keys of adjacent modular building units;

(b) supporting said brick within said mold with continuous void spaces along two opposed faces and a connecting end face of said brick, said adjacent surfaces of said mold being dimensionally accurate;

(c) introducing uncured mortar into said mold and within said continuous void spaces to cause molding of mortar mounting strips along said two opposed faces and said connecting end face of said brick;

(d) allowing said mortar on said brick to set; and (e) removing said brick with said mortar mounting strips thereon from said mold with outer surfaces of said mortar mounting strips being dimensionally accurate for forming a modular building unit with said mortar mounting strips being connected along their entire length to adjoining modular building units to precisely orient and space said brick with respect to at least one adjacent modular building unit.

31. The method of claim 30, including the further step of causing said internal mounting strip molding surfaces to mold said pair of mortar strips along an additional end face of said brick.

32. The method of claim 30, wherein said step of supporting said brick within said mold includes having said internal mounting strip molding surfaces forming said void spaces defining a predetermined mounting strip pattern between said mold and said brick so that the outer surfaces of said mounting strips are dimensionally accurate.

33. The method set forth in claim 30, including the following steps:

(a) said internal mounting strip molding surfaces forming a projection on said mortar strips for a first portion of a length of each strip; and (b) said internal mounting strip molding surfaces forming a groove on each of said continuous mortar mounting strips for a second portion of said length of each mounting strip.

34. The method of securing a pair of continuous mortar strips as defined in claim 33, further comprising:

providing said mold with a mating groove for said projection on each of said mortar strips and with a mating projection for said groove on each of said mortar strips.

35. A method of forming a generally vertical wall having a plurality of horizontal layers of interfitting modular building units arranged in end to end relation in each layer; said method comprising the following steps:

forming modular building units, comprising the steps of:

providing a block of a homogenous material for each building unit including a pair of parallel rectangular end faces, a pair of parallel rectangular side faces, and parallel rectangular upper and lower faces;

molding a continuous mounting strip about the periphery of each block including said end faces and said upper and lower faces and spaced inwardly of said side faces;

providing portions on said mounting strip for interfitting with mounting strips on adjacent blocks along the periphery of said mounting strip;

forming a projection on said strip for one half of the length of said strip about the periphery of said block;

forming a groove in said strip for the remaining one half of the length of said strip about the periphery of said block;

forming a planar surface on said mounting strip on each side of said groove and each side of said projection parallel to the adjacent associated face of said block;

wherein a height H is defined between a planar surface of said mounting strip on said upper face and a planar surface of said mounting strip on said lower face;

wherein the height H is dimensionally consistent as a result of the step of molding a continuous mounting strip; and forming the generally vertical wall, further comprising the steps of:

placing a lower layer of modular building units in end to end relation with interfitting strips on contiguous end faces of said building units; and adding a superjacent layer of modular building units to said lower layer with interfitting strips on contiguous upper and lower faces of building units in the adjacent layers, the superjacent layer of modular building units being supported on said mounting strip of the lower layer of modular building units by supporting each superjacent building unit on the planar surfaces of a strip on the upper face of a subjacent block.

36. The method of claim 35 wherein the step of forming modular building units further comprises the steps of:

providing a mold for said block of homogenous material, said mold having dimensional internal molding surfaces;

placing said block of homogenous material in said mold with said internal molding surfaces defining void space on the periphery of said block of homogenous material including said end faces and said upper and lower faces of the block; and introducing uncured mortar into said mold and filling said void space and allowing said uncured mortar to cure, said mortar defining said continuous mounting strip and said block and mortar forming a finished modular building unit having precise dimensions.

37. The method of claim 35 wherein the step of forming the generally vertical wall further comprises the step of placing adhesive securing means on at least some of the planar surfaces of the mounting strips to secure adjacent building units to each other.

38. The method of claim 35:

wherein a length L is defined between a planar surface of said mounting strip on a first of said parallel rectangular end faces and a planar surface of said mounting strip on a second of said parallel rectangular end faces; and wherein the length L is dimensionally consistent as a result of the step of molding a continuous mounting strip.

39. The method of claim 35:

wherein the continuous mounting strip comprises a first continuous mounting strip;

wherein the step of forming modular building units further comprises the step of molding a second continuous mounting strip abut the periphery of each block about the periphery of each block including said end faces and said upper and lower faces and spaced inwardly of said side faces;

wherein a width W is defined between the first continuous mounting strip and the second continuous mounting strip; and wherein the width W is of precise dimensions to insure an accurate interfitting relation between adjacent modular building units.

40. The method of claim 35 wherein the step of forming modular building units further comprises the step of forming a half modular building unit having cured mortar molded thereto at upper and lower surfaces and at at least one end surface thereof and defining connecting surfaces at said upper and lower surfaces and at said at least one end surface thereof, wherein said connecting surfaces at said upper, lower, and said at least one end surface are oriented for interfitting with adjacent modular building units.

41. The method of claim 35 wherein the block of homogenous material comprises a brick and wherein the continuous mounting strip comprises a mortar layer.

42. The method of claim 35 wherein the block comprises stone.

43. The method of claim 35 wherein the block comprises concrete.

44. The method of claim 35 wherein the block comprises glass.

45. The method of claim 35 wherein the block comprises tile.

46. The method of claim 35 wherein the block comprises decorative glass block.

47. The method of claim 35 wherein the block comprises a scaled down building block.

48. The method of claim 35, wherein the step of placing comprises placing with automated equipment.

49. The method of claim 35 wherein the step of forming the generally vertical wall further comprises:

locating a corner building block formed of a homogenous material and including a pair of parallel rectangular end faces, a pair of parallel rectangular side faces, and parallel rectangular upper and lower faces;

the corner building block comprising a first mounting strip extending along said upper and lower faces and one of said end faces;

locating an adjacent modular building unit extending in one direction and having a mounting strip interfitting with said first mounting strip on said one of said end faces on said corner building block;

the corner building block further comprising a second molded mounting strip extending along said upper and lower faces and one of said side faces of said corner block; and locating another adjacent modular building unit extending in a direction at right angles to said first mentioned adjacent modular building unit and interfitting with said second mounting strip on said one of said side faces on said corner building block.

50. The method of claim 49 and further comprising the steps of forming the corner building block, comprising the steps of:

forming a block formed of a homogenous material and including a pair of parallel rectangular end face, a pair of parallel rectangular side faces, and parallel rectangular upper and lower faces;

molding a mounting strip along said upper and lower faces and one of said end faces interfitting with a first adjacent modular building unit extending in one direction; and molding another mounting strip extending along said upper and lower faces and one of said side faces interfitting with a second adjacent modular building unit extending at right angles to said first mentioned modular building unit;

said mounting strips being formed of a material different from said homogenous material of said block and secured to said block after said block is formed.

* * * * *